US005271186A

United States Patent [19]

Perneczky

[11] Patent Number: 5,271,186

[45] Date of Patent: Dec. 21, 1993

[54] TANDEM PNEUMATIC/HYDRAULIC RECIPROCATING CYLINDER WITH INTEGRAL OIL RESERVOIR

[76] Inventor: George C. Perneczky, 8918 Biloba, Orland Park, Ill. 60462

[21] Appl. No.: 882,304

[22] Filed: May 13, 1992

[51] Int. Cl.[5] ..... B24B 5/37; B24B 47/06

[52] U.S. Cl. ..... 51/165.9; 51/289 R; 51/59 R

[58] Field of Search ..... 51/59 R, 165.9, 165.85, 51/165.71, 289 R, 252; 251/324, 325

[56] References Cited

U.S. PATENT DOCUMENTS 2,580,751 1/1952 Fletcher ..... 51/165.9
4,528,716 7/1985 Perneczky ..... 15/256.51
4,633,999 1/1987 Perneczky ..... 198/499
4,841,675 6/1989 Perneczky ..... 51/67
4,887,329 12/1989 Perneczky ..... 15/256.53
5,015,303 5/1991 Perneczky ..... 134/32

FOREIGN PATENT DOCUMENTS 0465864 9/1981 U.S.S.R. ..... 51/165.9
0950970 8/1982 U.S.S.R. ..... 51/165.9

*Primary Examiner*—Robert A. Rose
*Attorney, Agent, or Firm*—Roper & Quigg

[57] ABSTRACT

The present invention relates to a tandem pneumatic/-hydraulic reciprocating cylinder with an integral oil reservoir. The invention may be used to impart reciprocating motion to adjustable apparatus used in the cleaning and polishing of roll assemblies.

3 Claims, 3 Drawing Sheets

TANDEM PNEUMATIC/HYDRAULIC RECIPROCATING CYLINDER WITH INTEGRAL OIL RESERVOIR

BACKGROUND OF THE INVENTION

1. Field of the Invention

The present invention relates generally to an adjustable apparatus for use in cleaning and polishing roll assemblies used in the rolling of sheet stock such as, for example, sheet steel, sheet plastic, paper, and the like. More particularly, the invention relates to an apparatus that incorporates a tandem pneumatic/hydraulic reciprocating cylinder with an integral oil reservoir in its design.

2. Description of the Prior Art

In my U.S. Pat. No. 4,841,675, issued on Jun. 27, 1989, I disclosed an apparatus for cleaning and polishing roll assemblies. According to this patent, a pneumatic cylinder causes reciprocating movement of the first end unit of the apparatus and a separate hydraulic cylinder associated with the second end unit dampens that movement. The two end units of the apparatus disclosed in this patent independently support the pneumatic and hydraulic cylinders, as well as the main shaft, and associated polishing surfaces, of the apparatus.

When the pneumatic cylinder of Pat. No. 4,841,675 is actuated during the operation of the apparatus, it is conceivable that undesirable stresses may be introduced into the assembly thereby giving rise to the possibility of early failure, binding in the apparatus, and excessive deflection in the main shaft.

In my U.S. Pat. No. 4,887,329, issued on Dec. 19, 1989, I disclosed a tandem arrangement of the pneumatic and hydraulic cylinders having a through rod. Tandem arrangements such as there disclosed have the beneficial effect of reducing undesirable stresses. However, in such tandem arrangements, air bubbles may develop in the hydraulic cylinder, for example, if an operator does not completely fill the hydraulic side of the tandem cylinder with hydraulic oil. Such air bubbles have the potential of causing the hydraulic cylinder to operate in an erratic or jerky motion. Operation in a jerky motion may be undesirable because an impact load would be put on the assembly and could result in an inconsistent wear pattern on the roll being polished.

Another problem in such tandem arrangements might occur due to thermal expansion. In order to adjust the speed of the reciprocating movement of the tandem cylinder, flow control valves restrict the oil flow from one port to the next. When the oil flow is restricted, heat could be generated due to friction. Such frictional heat may be transferred to the oil, resulting in an elevation of the oil's temperature, thereby possibly causing the oil body to expand. Because the oil cavity of the hydraulic cylinder is initially filled with oil, the expanding volume of oil could thus cause seal failure, allowing the oil to escape. Oil leakage is undesirable because air bubbles would then be able to enter the oil chamber and cause the jerky motion described above. Additionally, seal failure could cause the oil to continue to leak out of the oil chamber until the oil reached a very low level and the tandem cylinder assembly would fail.

With this general discussion of the problems associated with roll polishing and cleaning apparatuses in mind, it is a nonlimiting object of the present invention to provide an apparatus for cleaning and polishing roll assemblies which improves the performance of such apparatuses.

Another nonlimiting object of the invention is to eliminate air bubbles from the hydraulic cylinder of the apparatus, resulting in a smooth operation of the apparatus while cleaning and polishing the roll assemblies.

Yet a further nonlimiting object of the present invention is to eliminate thermal expansion which may result in seal leakage of oil from the hydraulic cylinder.

These nonlimiting described objects and the other objects and advantages of the present invention will become apparent to those skilled in the art with reference to the foregoing, the attached drawings, and the description of the invention which hereinafter follows.

SUMMARY OF THE INVENTION

The present invention provides an adjustable apparatus for use in cleaning and polishing roll assemblies. More particularly, the apparatus incorporates a tandem pneumatic/hydraulic reciprocating cylinder with an integral oil reservoir in its design.

The cylinder of the apparatus comprises an integral or built-in oil reservoir, flow control valves, and check valves. The advantage of the integral oil reservoir is that it is a compact assembly and operates as a closed-loop system. When the hydraulic side of the cylinder is filled, including partial filling of the oil reservoir, erratic or "jerky" motion that may be created by something as simple as air bubbles or as complex as thermal expansion is substantially eliminated. This advantage occurs due to the fact that the oil reservoir functions not only as an oil storage reservoir, but also as an expansion chamber.

DESCRIPTION OF THE PREFERRED EMBODIMENT

The present invention relates to an apparatus for cleaning and polishing roll assemblies, in particular, to an apparatus that incorporates a tandem pneumatic/hydraulic reciprocating cylinder with an integral oil reservoir in its design.

The present invention is useful in my invention disclosed in U.S. Pat. No. 4,841,675, entitled "An Apparatus for Cleaning and Polishing Roll Assemblies", which issued on Jun. 27, 1989 (hereinafter the "'675 patent"). The device disclosed in the '675 patent contains a reciprocating air cylinder 56 and a hydraulic snubber 58 (see FIG. 3 and FIG. 4 of the '675 patent). The reciprocating air cylinder 56 controls the movement of the main shaft 32 to allow that shaft to travel in a reciprocating motion along the length of the roll being cleaned and polished. The hydraulic snubber 58 acts to dampen this movement. However, when the reciprocating air cylinder 56 is operated, it is possible that stresses could be introduced into the assembly. The present invention is useful to eliminate such problems.

The present invention is also useful in my invention disclosed in U.S. Pat. No. 4,887,329, entitled "Low Profile Roll Cleaning Apparatus And Self Aligning Bearing Used Therein," which issued on Dec. 19, 1989. The invention there disclosed an arrangement of the pneumatic and hydraulic cylinders in tandem with a through rod (see FIG. 6). This tandem arrangement is successful in reducing undesirable stresses. However, other problems, such as air bubbles and thermal expansion, could develop. The present invention, which incorporates an integral oil reservoir, can thus be useful in eliminating these latter problems.

Figure 1:
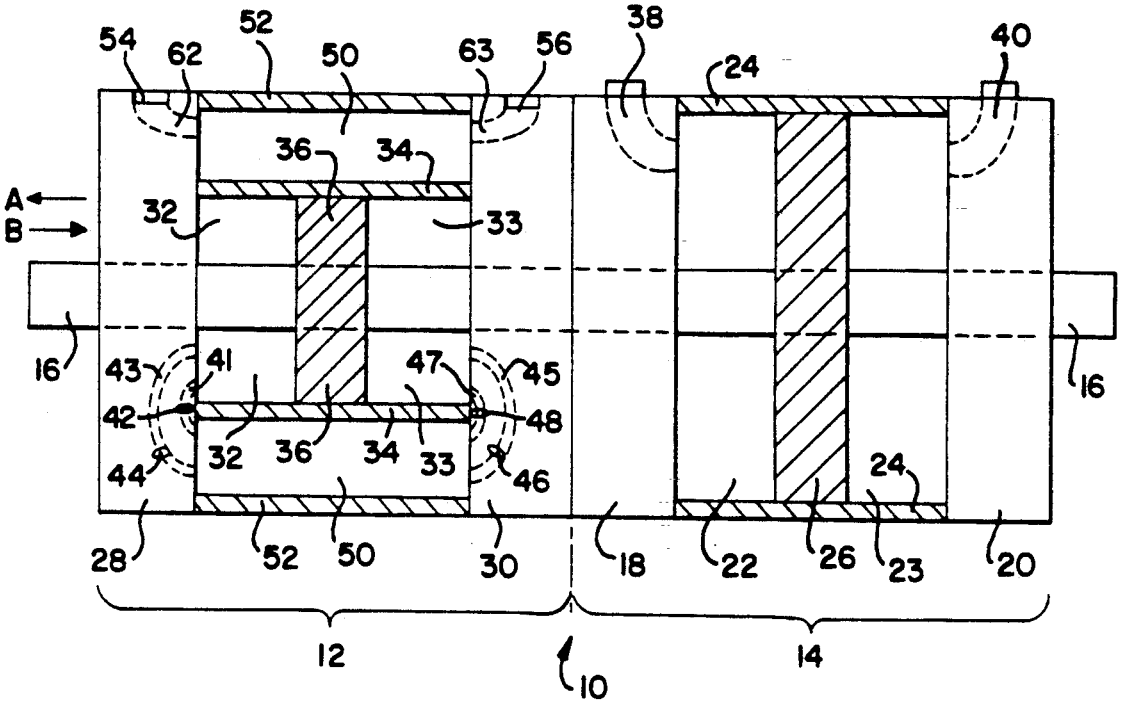
FIG. 1 is a schematic drawing of the tandem pneumatic/hydraulic reciprocating cylinder with an integral oil reservoir.

FIG. 1 of the present application depicts a simplified schematic of the novel tandem pneumatic/hydraulic reciprocating cylinder 10 of the present invention. The cylinder 10 includes a hydraulic side 12, a pneumatic side 14 and a rod 16 extending therethrough. The pneumatic side 14 is defined by end plates 18 and 20 and the air cavities 22 and 23 formed by cylinder 24 in conjunction with end plates 18 and 20 and a piston 26. The hydraulic side 12 is defined by end plates 28 and 30 and the oil cavities 32 and 33 formed by cylinder 34 in conjunction with end plates 28 and 30 and a piston 36. Oil is introduced into the hydraulic side by way of either or both of the oil ports 54 and 56. The oil flows through the oil port 62 or port 63 (or both), into the oil reservoir 50 which surrounds the cylinder 34. The oil cavity 32 communicates with the oil reservoir 50 through one or more lines 43, (for clarity only one such line 43 is shown in FIG. 1, it being understood that the number of such lines 43 may vary from one embodiment of the invention to another depending on such factors as the size of the cavity 32, the viscosity of the oil, etc.). Irrespective of the exact number of lines 43, each such line is fitted with a flow control valve, such as flow control valve 44. Flow control valve 44 is adjustable (as by manual or automatic adjustment) to regulate the flow of oil from the cavity 32 to the reservoir 50. Flow control valve 44 is preferably a one-way valve to provide a means to control the flow of oil from the cavity 32 to the reservoir 50. Similarly, the oil cavity 33 communicates with the oil reservoir 50 through one or more lines 45 (again for clarity only one such line 45 is shown in FIG. 1, it being understood that the foregoing comments relating to line 43 apply also to line 45). As with line 43, line 45 is fitted with a flow control valve 46. The flow control valve 46 operates in the manner described for flow control valve 44. The cavity 32 and the cavity 33 also communicate with the reservoir 50 through line 41 and check valve 42 and line 47 and check valve 48, respectively, as described hereinafter.

When it is desired to move rod 16 in the direction depicted by the arrow labelled (A), air is applied to air line 40 of the pneumatic side 14 into air cavity 23. As the air forces rod 16 to move in the direction (A), the rod 16 pushes the piston 36 in the hydraulic side 12, forcing oil found in the oil cavity 32 out and through the line 43 and flow control valve 44 into the oil reservoir 50. As the oil pressure in reservoir 50 increases, check valve 48 opens and oil flows from the oil reservoir 50, through the line 47 and check valve 48, into the oil cavity 33. To ensure that the increase in oil pressure in the reservoir 50 does not result in a back flow of oil into the cavity 32 through the line 41 and check valve 42, check valve 42 is preferably a one-way valve. The one-way action of check valve 42 may be controlled by a biased spring or ball float included within the valve 42. The valve 42 operates such that as the piston 36 travels in the direction (A), oil which is forced into a portion of the line 41 acts to close the check valve 42; because the pressure of the oil operating on the check valve 42 is greater than the oil pressure in the reservoir 50, during this stroke the valve 42 will remain closed. With respect to the check valve 48, the pressure of the oil in the reservoir 50 is greater than that in cavity 33, thus the oil flows trough line 47 and check valve 48 in to cavity 33. In order to ensure that the oil flows at a more uniform rate into cavity 33, flow control valve 46 is also preferably provided with one-way action during this stoke. That is, oil flowing from the reservoir 50 through a portion of the line 45 closes flow control valve 48.

The oil, particularly low viscosity oil, thus flows smoothly through the flow control valve 44 and check valve 48, thereby creating a uniform movement of the piston 36 and the rod 16. In particular, as oil flows from the cavity 32 to the reservoir 50, flow control valve 44 in open and check valve 42 is closed. As oil flows from the reservoir 50 to cavity 33, check valve 48 is open and flow control valve 46 is closed.

To move the rod 16 in the direction depicted by the arrow labelled (B), the opposite of the above occurs. Air is applied to air line 38 of the pneumatic side 14 into air cavity 22. As the air forces rod 16 to move in the direction (B), the rod 16 pulls the piston 36 in the hydraulic side 12, forcing oil found in the oil cavity 33 out and through the flow control valve 46, and into the oil reservoir 50. Simultaneously, oil flows out of the oil reservoir 50, through check valve 42, filling the oil cavity 32. In this situation, as oil flows from the cavity 33 to the reservoir 50, flow control valve 46 is open and check valve 48 is closed. As oil flows from the reservoir 50 to the cavity 32, check valve 42 is open and flow control valve 44 is closed.

The advantage of the oil reservoir 50 is that it is a compact assembly and acts as a closed-loop system. When the hydraulic side 12 of the tandem cylinder 10 is filled, including a partial filling of the oil reservoir 50, erratic or jerky motion that may be created by air bubbles or thermal expansion is significantly reduced. Also, because the oil reservoir 50 is integral to the tandem cylinder 10, the use of seals, gaskets and the like is significantly reduced. This provides the advantage of reducing the prospects of oil leakage.

Finally, to control the limit of travel of the rod 16, limit switches may be associated with the rod 16, being positioned external to either the hydraulic or pneumatic side of the cylinder 10 or internal to either. Such limit switches, and the associated circuitry to control the flow of air into the pneumatic side 14, are well known in the art and for brevity will not be described herein.

Figure 2:
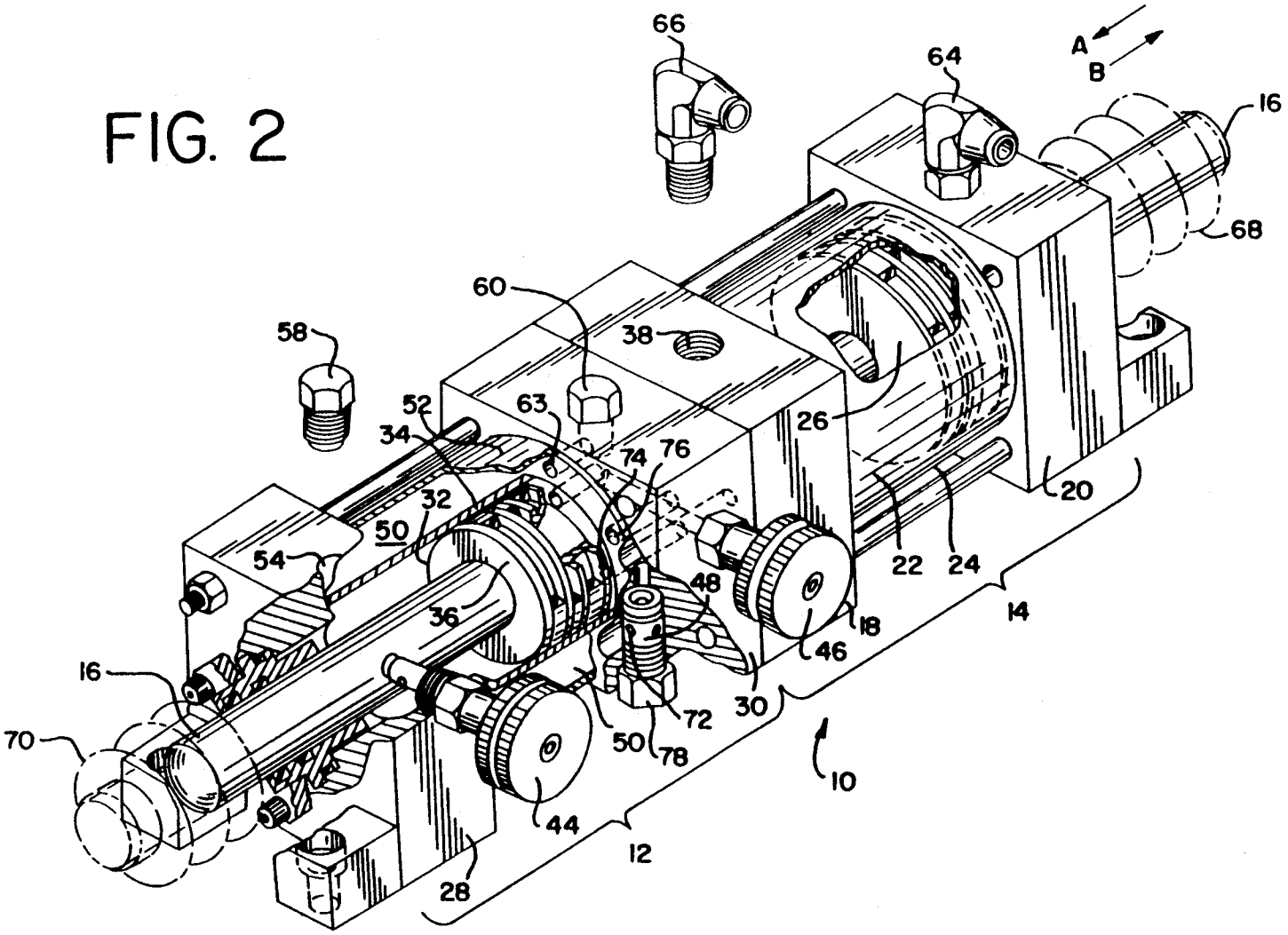
FIG. 2 is a perspective partial exploded cross-sectional view of the tandem pneumatic/hydraulic reciprocating cylinder with an integral oil reservoir.

FIG. 2 depicts a perspective, partial exploded cross-sectional view of the tandem pneumatic/hydraulic reciprocating cylinder 10 with the integral oil reservoir 50. The rod 16 is shown as covered at its right end with a boot 68 and at its left end with a boot 70. The boots 68 and 70 protect rod 16 from the outer environment of the roll assembly. To introduce oil into the hydraulic side 12, bolt 58 or bolt 60 (or both) of oil fill port 54 and oil fill port 56 (not shown), respectively, are removed. Oil is then introduced and flows through oil ports 62 (not shown) or 63 (or both) into the oil reservoir 50.

After the oil is introduced to the tandem cylinder 10, operation can begin. To move the rod 16 in the direction depicted by the arrow (A), air is supplied to air line 40 (not shown) through the air supply connector 64.

As air is applied to the air line 40 (not shown) through the air supply connector 64, the rod 16 begins to move, causing both the pneumatic piston 26 and the hydraulic piston 36 to move. The hydraulic piston 36 moves, which forces oil found in the oil cavity 32 out and through the flow control valve 44 into the oil reservoir 50.

Simultaneously, oil flows out of the oil reservoir 50, through oil port 72 of check valve 48 and into the oil cavity 33 (not shown). The check valve 48 is associated with the end plate 30 of the hydraulic side 12. Once the pneumatic piston 26 has reached the end of its travel at or near end plate 18 and the hydraulic piston 36 has reached a location at or near the plate 28, the rod 16 has moved completely in direction (A) and is now able to move in direction (B).

To move rod 16 in the direction depicted by the arrow (B), air is applied to the air line 38 through the air supply connector 66. As the hydraulic piston 36 is moved in the direction (B), oil found in oil cavity 33 (not shown) is forced through the flow control valve 46 and into the oil reservoir 50. Simultaneously, oil flows out of oil reservoir 50 and through check valve 42 (not shown) to the fill the oil cavity 32.

The check valve 42 (not shown) and check valve 48 control the flow of oil into and out of the oil reservoir 50. The flow control valve 44 is in fluid communication with oil cavity 32 such that the flow of oil from the oil reservoir 50 into the oil cavity 32 can be regulated. The flow control valve 46 is in fluid communication with oil cavity 33 (not shown) such that the flow of oil from the oil reservoir 50 into the oil cavity 33 (not shown) can be regulated. The flow control valves 44 and 46 can also be used to effect the damping of the pneumatic side 14. The flow control valve 44 and flow control valve 46 have a greater degree of adjustment than the check valve 42 and check valve 48 and can thus be used to regulate with more control the oil flow in the tandem cylinder 10.

Figure 4:
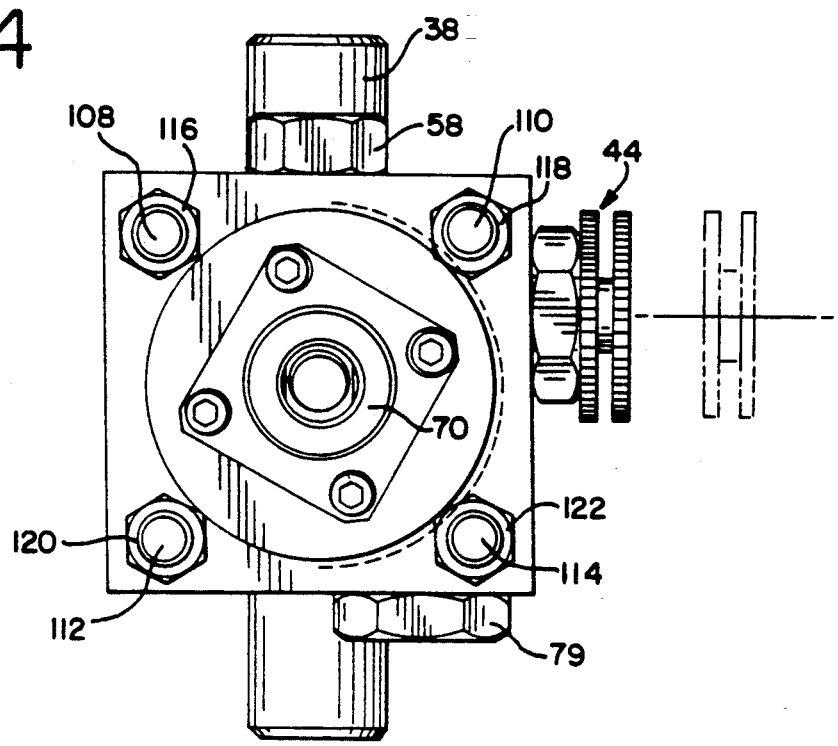
FIG. 4 is an end view of the tandem pneumatic/hydraulic reciprocating cylinder with an integral oil reservoir taken along the lines A—A of FIG. 3.
Figure 3:
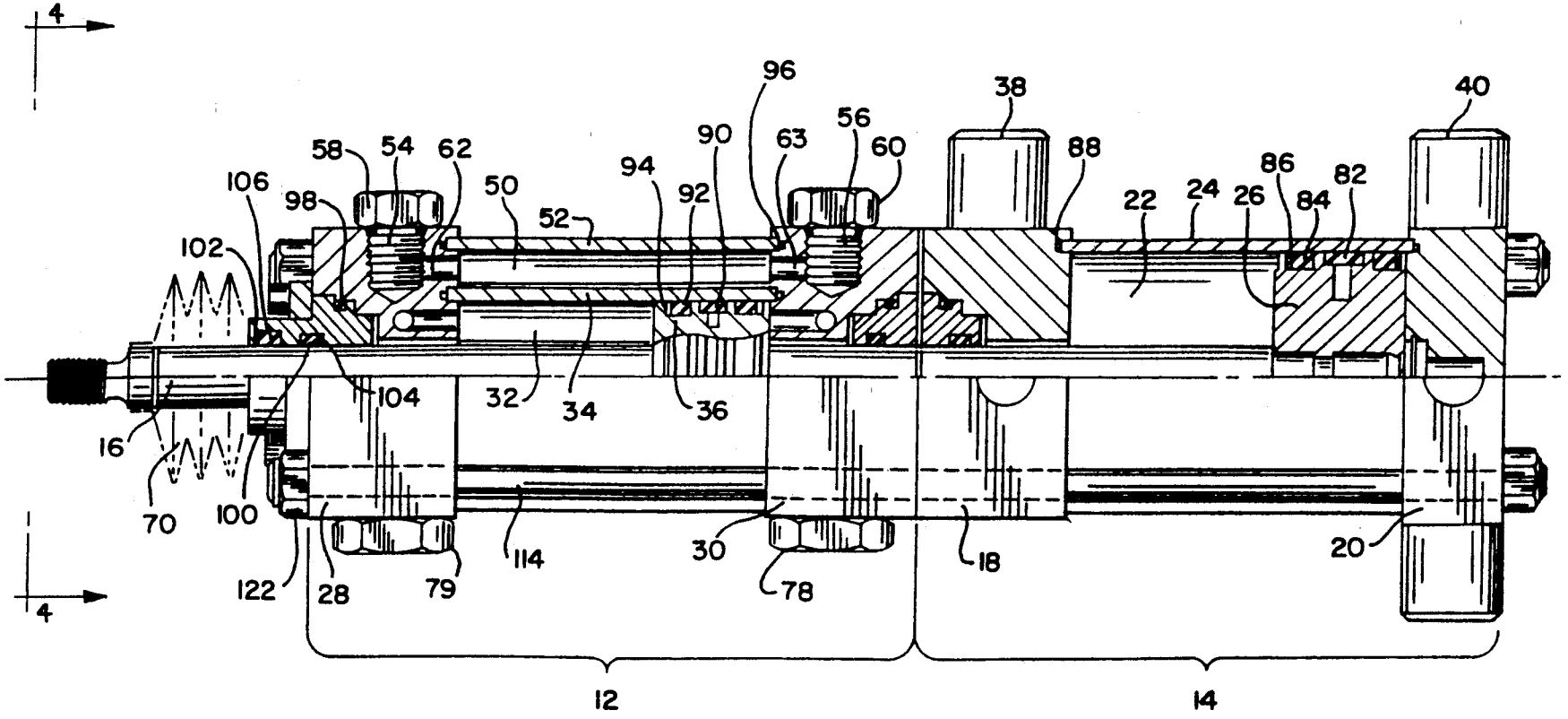
FIG. 3 is a side view with a partial cross-sectional view of the tandem pneumatic/hydraulic reciprocating cylinder with an integral oil reservoir.

FIG. 3 depicts a side, partial cross-sectional view of the tandem pneumatic/hydraulic reciprocating cylinder 10 with the integral oil reservoir 50. FIG. 4 is an end view of the tandem pneumatic/hydraulic reciprocating cylinder 10 taken along the lines A—A of FIG. 3.

FIG. 3 shows a partial cross-sectional view of the pneumatic piston 26 and the hydraulic piston 36. The pneumatic piston 26 contains a cartridge O-ring 82 and a piston seal 84, which contains a felt piston seal 86. Also, the pneumatic cylinder 24 contains an O-ring 88.

Similar to the pneumatic piston 26, the hydraulic piston 36 contains a cartridge O-ring 90 and a piston seal 92, which contains a felt piston seal 94. The outer hydraulic cylinder 52 contains an O-ring 96.

FIG. 3 also shows a partial cross-sectional view of the end plate 28. The plate 28 also contains a cartridge O-ring 98, a rod seal 100 and a rod wiper 102. The rod seal 100 contains a felt rod seal 104 and the rod wiper 102 contains a felt rod wiper 106. Comparable elements (not shown) are also associated with the end plate 20.

As shown in FIG. 2 of my '675 patent, the cleaning apparatus has a first end unit and a second end unit. As shown in FIG. 1 and FIG. 2 of my '329 patent, the tandem cylinder can be connected to either end of the cleaning apparatus. FIG. 4 of the present invention shows the connection between the tandem cylinder 10 and the cleaning apparatus. Support rods 108, 110, 112, 114 extend over the distance of the tandem cylinder 10 and are connected by way of bolts 116, 118, 120, 122, in order to hold the end plates 20 and 28 in alignment. The rod 16 may be attached to main shaft attachment plate 38 of my '675 patent, or directly to the support assembly 10 of my '329 patent.

As stated above, the incorporation of the oil reservoir 50 in the design of the tandem cylinder 10 eliminates erratic motion of the tandem cylinder 10 that can be caused by air bubbles or thermal expansion of the oil in the hydraulic side 12. Such erratic motion of the tandem cylinder 10 could result in an inconsistent wear pattern on the roll to be polished.

These and other advantages of the present invention will be readily apparent to one skilled in the art.

While the foregoing invention has been shown and described with reference to the attached drawings and a preferred embodiment, it will be appreciated that modifications and changes to the foregoing can be made while still falling within the intent and spirit of the invention.

What is claimed is:

1. In an apparatus for cleaning and polishing the surface of a cylindrical roll, which apparatus comprises a shaft removably attached at one end thereof to a first end unit and removably attached at the other end thereof to a second end unit, said first and second end units each being provided with lift means for moving said shaft from a first position to a second position, a reciprocating means operably connected to said shaft, at least one abrasive stone support means attached to said shaft, with each such support means including an arm having a resilient joint associated therewith and an abrasive stone attached thereto, and a control means cooperating with said lift means for moving said shaft from said first position to said second position and further cooperating with said reciprocating means for translating said shaft alternately along its longitudinal axis, wherein the improvement of said reciprocating means comprises:

a tandem cylinder comprising a pneumatic section having spaced apart first and second end plates and a wall segment lying therebetween to define a pneumatic chamber and a hydraulic section having spaced apart third and fourth end plates and a wall segment lying therebetween to define a hydraulic chamber, with the second end plate of said pneumatic section being attached to the third end plate of said hydraulic section, a rod extending through said pneumatic and said hydraulic chambers and beyond the first end plate of said pneumatic section and beyond the fourth end plate of said hydraulic section, said pneumatic chamber including a first piston attached to said rod, a first air inlet positioned adjacent said first end plate and a second air inlet positioned adjacent said second end plate and a pneumatic fluid source means for alternate application of pneumatic fluid to said first air inlet and was second air inlet, said hydraulic chamber including a second piston attached to said rod and a first hydraulic fluid line and a first flow line position adjacent said third end plate and a second hydraulic fluid line and a second flow line positioned adjacent said fourth end plate, with each of said first and second hydraulic fluid lines including a flow control valve and each of said first and second flow lines including a check valve, a hydraulic fluid reservoir having at least one hydraulic fluid inlet, with said hydraulic fluid reservoir being in fluid communication with said hydraulic chamber through said first and second hydraulic fluid lines and said first and second flow lines, and a limit switch means operably connected to said pneumatic source means to alternate the flow of pneumatic fluid through said first air inlet and said second air inlet.

2. In an apparatus for automatically cleaning contaminants from a circulating surface having a surface width perpendicular to its direction of motion, which apparatus comprises a means for orienting at least one polishing block having a face parallel to said circulating surface along said surface width, a means for swingingly engaging said at least one polishing block with said circulating surface about a supporting axis of rotation, and a means for reciprocally scrubbing said circulating surface with each said polishing block along said entire circulating surface width, wherein the improvement of said means for reciprocally scrubbing comprises:

a tandem cylinder comprising a pneumatic section having spaced apart first and second end plates and a wall segment lying therebetween to define a pneumatic chamber and a hydraulic section having spaced apart third and fourth end plates and a wall segment lying therebetween to define a hydraulic chamber, with the second end plate of said pneumatic section being attached to the third end plate of said hydraulic section, a rod extending through said pneumatic and said hydraulic chambers and beyond the first end plate of said pneumatic section and beyond the fourth end plate of said hydraulic section, said pneumatic chamber including a first piston attached to said rod, a first air inlet positioned adjacent said first end plate and a second air inlet positioned adjacent said second end plate and a pneumatic fluid source means for alternate application of pneumatic fluid to said first air inlet and was second air inlet, said hydraulic chamber including a second piston attached to said rod and a first hydraulic fluid line and a first flow line position adjacent said third end plate and a second hydraulic fluid line and a second flow line positioned adjacent said fourth end plate, with each of said first and second hydraulic fluid lines including a flow control valve and each of said first and second flow lines including a check valve, a hydraulic fluid reservoir having at least one hydraulic fluid inlet, with said hydraulic fluid reservoir being in fluid communication with said hydraulic chamber through said first and second hydraulic fluid lines and said first and second flow lines, and a limit switch means operably connected to said pneumatic source means to alternate the flow of pneumatic fluid through said first air inlet and said second air inlet.

3. A tandem cylinder comprising a pneumatic section having spaced apart first and second end plates and a wall segment lying therebetween to define a pneumatic chamber and a hydraulic section having spaced apart third and fourth end plates and a wall segment lying therebetween to define a hydraulic chamber, with the second end plate of said pneumatic section being attached to the third end plate of said hydraulic section, a rod extending through said pneumatic and said hydraulic chambers and beyond the first end plate of said pneumatic section and beyond the fourth end plate of said hydraulic section, said pneumatic chamber including a first piston attached to said rod, a first air inlet positioned adjacent said first end plate and a second air inlet positioned adjacent said second end plate and a pneumatic fluid source means for alternate application of pneumatic fluid to said first air inlet and was second air inlet, said hydraulic chamber including a second piston attached to said rod and a first hydraulic fluid line and a first flow line position adjacent said third end plate and a second hydraulic fluid line and a second flow line positioned adjacent said fourth end plate, with each of said first and second hydraulic fluid lines including a flow control valve and each of said first and second flow lines including a check valve, a hydraulic fluid reservoir having at least one hydraulic fluid inlet, with said hydraulic fluid reservoir being in fluid communication with said hydraulic chamber through said first and second hydraulic fluid lines and said first and second flow lines, and a limit switch means operably connected to said pneumatic source means to alternate the flow of pneumatic fluid through said first air inlet and said second air inlet.

* * * * *